US005662175A

United States Patent [19]

Warrington et al.

[11] Patent Number: 5,662,175

[45] Date of Patent: Sep. 2, 1997

[54] SEA WATER PILE HAMMER

[75] Inventors: Don C. Warrington, Chattanooga, Tenn.; Vladimir A. Nifontov, Moscow, Russian Federation; Lev V. Erofeev, Moscow, Russian Federation; Dmitri A. Trifonov-Yakovlev, Moscow, Russian Federation

[73] Assignee: Vulcan Iron Works, Inc., Chattanooga, Tenn.

[21] Appl. No.: 512,459

[22] Filed: Aug. 8, 1995

[51] Int. Cl.[6] ..... E02D 7/10; E02D 7/28

[52] U.S. Cl. ..... 173/132; 173/115; 173/128; 173/DIG. 1

[58] Field of Search ..... 173/19, 31, 32, 173/81, 89, 115, 128, 132, 141, 211, DIG. 1, 210

[56] References Cited

U.S. PATENT DOCUMENTS

| | | | |
|---|---|---|---|
| 3,115,198 | 12/1963 | Kuss | 173/128 X |
| 3,454,112 | 7/1969 | Warrington | 173/128 |
| 4,043,405 | 8/1977 | Kühn | 173/DIG. 1 X |
| 4,075,858 | 2/1978 | Frederick | 173/DIG. 1 X |
| 4,367,800 | 1/1983 | Arentsen | 173/DIG. 1 X |
| 4,408,668 | 10/1983 | Kühn et al. | 173/128 X |
| 4,479,550 | 10/1984 | Kühn et al. | 173/DIG. 1 X |

*Primary Examiner*—Joseph J. Hail, III
*Assistant Examiner*—Jay A. Stelacone
*Attorney, Agent, or Firm*—Mason, Kolehmainen, Rathburn & Wyss

[57] ABSTRACT

A pile hammer for driving down hollow piles from an upper end thereof includes a hollow pile cap adapted to rest and support the hammer on a upper end of the pile being driven. The cap has an anvil surface for receiving blows from a ram which is slidably disposed on a hollow tubular base extending downwardly from the pile cap and having a lower end portion extending into the hollow pile being driven below the level of the pile cap. The ram is slidable on an upper portion of the hollow tubular base and has an annular lower end face adapted to strike the anvil surface of the pile cap when the ram is released to drop from an elevated position above the pile cap. A ram lift system is provided in an upper portion of the hollow tubular base for lifting the ram to an elevated position a selected predetermined height above the pile for release to drop downwardly and strike a driving blow against the anvil surface on the pile cap. The pile hammer is supported completely on the pile being driven and other means of support are not required. Sea water may be used as the operating fluid of the pile hammer and the hammer is operable above or below the water or on dry land. The pile hammer includes a remotely controllable, fluid control system for operating the pile hammer in an automatic or manual mode and the pile hammer does not require a waterproof enclosure.

24 Claims, 5 Drawing Sheets

SEA WATER PILE HAMMER

BACKGROUND—FIELD OF INVENTION

The present invention relates to a new and improved sea water pile hammer which is designed to use water as a hydraulic fluid and which is operable both above and below the surface of the water or on dry land and which does not require a waterproof casing.

BACKGROUND—DESCRIPTION OF PRIOR ART

The primary purpose of pile driving equipment is to drive piles into the earth and so to support structures and prevent them from undesired movement. These include structures which are partially or entirely under the surface of the water, and whose pile may or may not be partially or entirely under the surface of the water. In these cases piles may be driven either from above the water or under its surface.

Concerning hammers which are designed to drive piles under the surface of the water, the prior art has many examples of hammers which require that the casing surrounding the impacting ram be capable of preventing the ingress of water into the mechanism and so to impede the downward velocity of the ram. This can be accomplished in a variety of ways, including sealing the case from water ingress, use of a compressed air source to force any water inside of the case out, and other means.

The weakness with all of these methods is that they require special measures to prevent the ingress of water into the case, whether this be to prevent damage to the interior parts or to prevent excessive drag on the ram during its motion, and they require that these measures be reasonably free of failure, lest the hammer be rendered inoperable by the ingress of water.

OBJECTS AND ADVANTAGES

Accordingly, several objects and advantages of our invention are to provide a new and improved sea water pile hammer and more particularly to provide a new and improved sea water pile hammer which can operate both above and below the surface of the water without requiring a waterproof casing in either case;

to provide a new and improved sea water pile hammer of the character described which is completely supported by a pile cap which rests on and is supported by the pile being driven;

to provide a new and improved sea water pile hammer of the character described in which a central tubular base extends downwardly inside of a pile being driven for guidance and limiting both the angle and the offset between the longitudinal axis of the pile cap and the longitudinal axis of the hollow piling;

to provide a new and improved sea water pile hammer of the character described which has a new and unique pile cap provided with radial slots for reducing energy loss during a driving blow;

to provide a new and improved sea water pile hammer of the character described which has a minimal width dimension relative to the length and incurs minimal water disturbance when the ram or hammer is dropped onto an anvil surface of a pile cap to drive a pile;

to provide a new and improved sea water pile hammer of the character described which has a remotely controllable adjustable setting of ram rise before release to obtain a downward driving hammer stroke of a desired force;

to provide a new and improved sea water pile hammer of the character described utilizing sea or fresh water as a hydraulic fluid for lifting the ram and which is capable of both manual and automatic operation controlled from a location remote from the pile hammer. Still further objects and advantages will become apparent from a consideration of the ensuing description and accompanying drawings.

Figure 5:
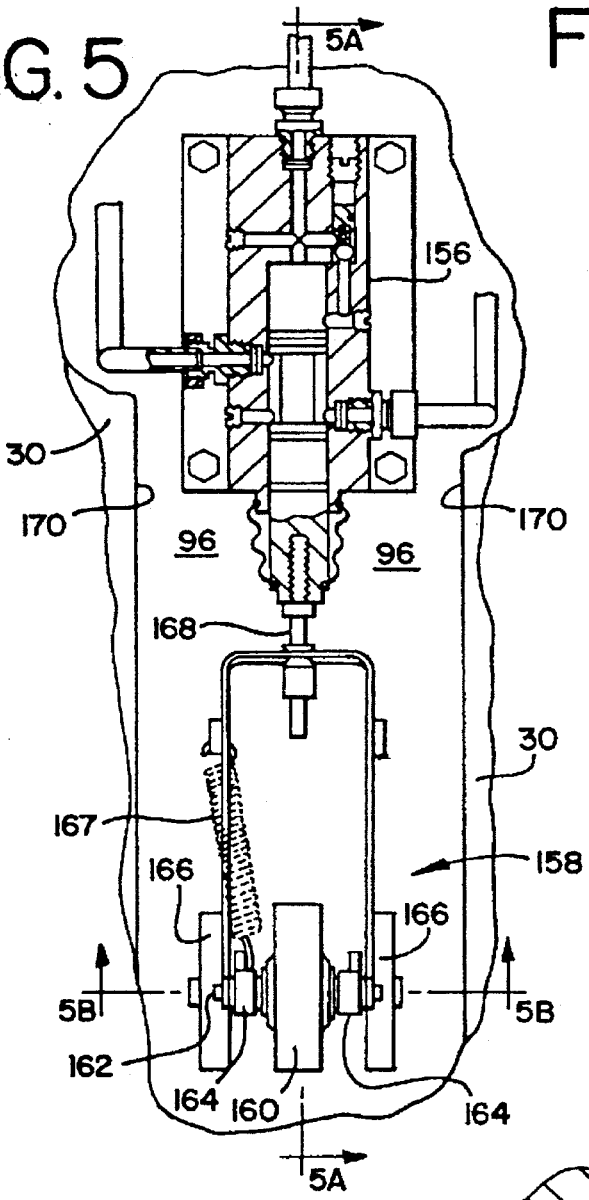
FIG. 5 is an enlarge fragmentary side elevational view of a portion of the pile hammer looking in the direction of arrows 5—5 of FIG. 1.

FIG. **5*a* is a cross-sectional view taken substantially along lines of 5A—5A of FIG. 5**.

FIG. **5*b* is a fragmentary cross-sectional view taken substantially along lines 5B—5B of FIG. 5**.

Figures 1, 2, 3, 4:
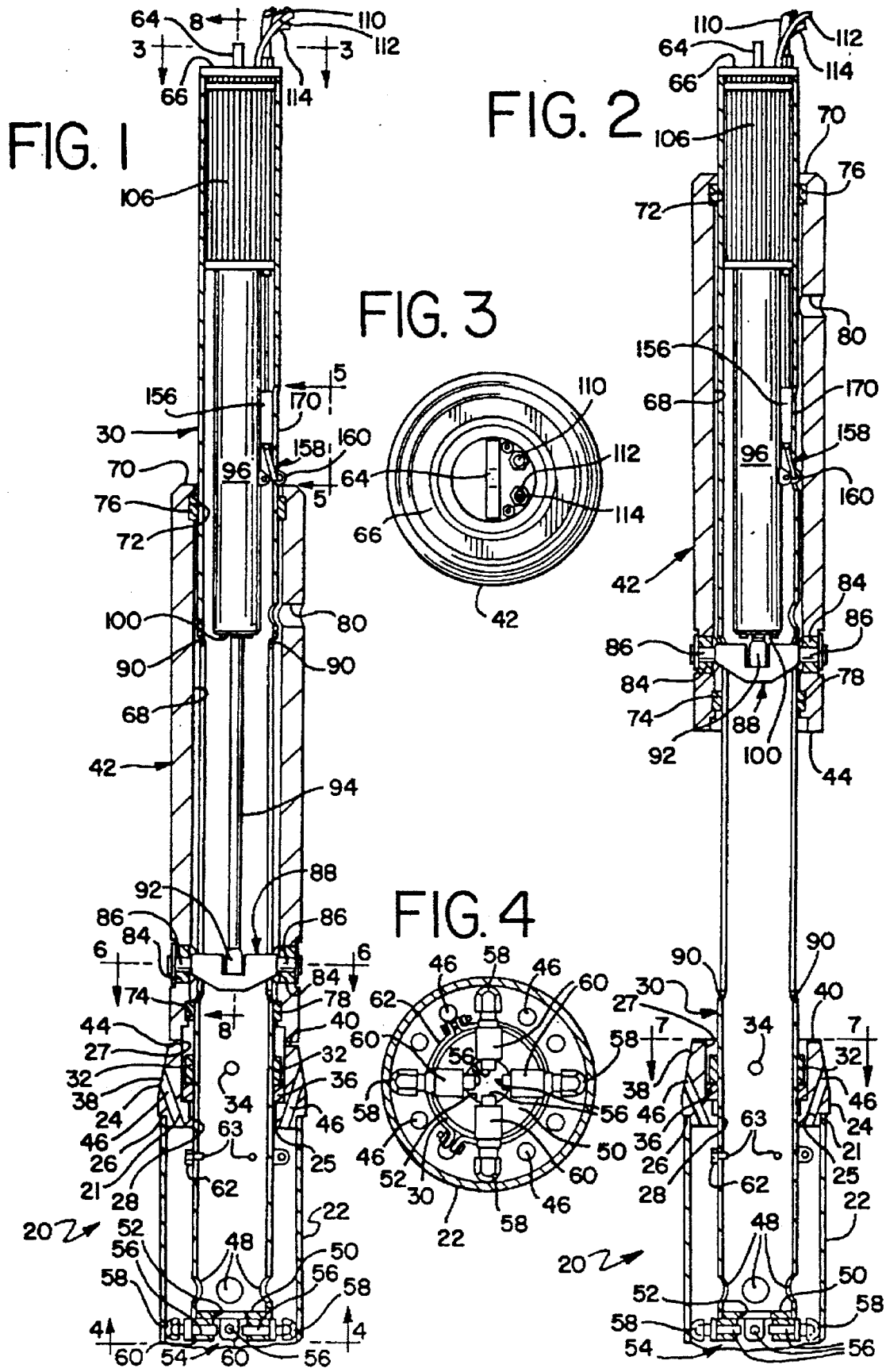
FIG. 1 is a longitudinal cross-sectional view of a new and improved sea water pile hammer constructed in accordance with the features of the present invention and illustrating a ram of the hammer in a lower position resting on an anvil surface of a hollow pile cap.
FIG. 2 is a view similar to FIG. 1, but illustrating the ram in an elevated position ready to be dropped to strike a driving blow.
FIG. 3 is an upper end or top view of the pile hammer looking downwardly in the direction of arrows 3—3 of FIG. 1.
FIG. 4 is a transverse cross-sectional view of the pile hammer taken substantially along lines 4—4 of FIG. 1.
Figure 6:
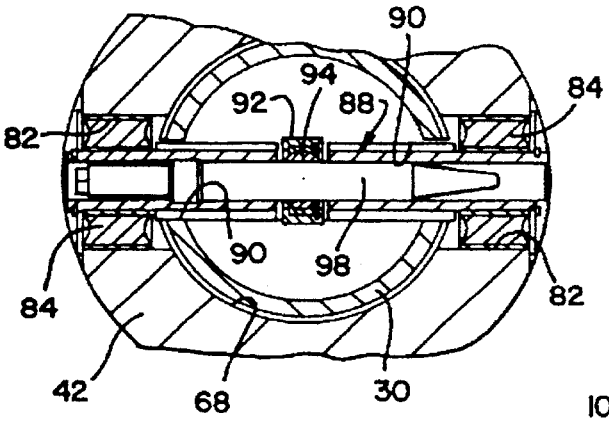

FIG. 6 is a transverse cross-sectional view taken substantially along lines 6—6 of FIG. 1.

Figure 7:
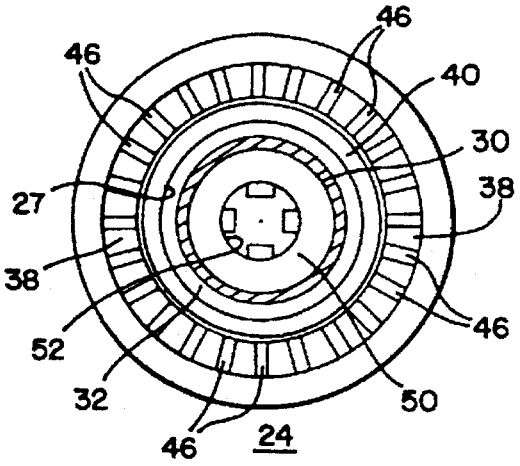

FIG. 7 is a transverse cross-sectional view taken substantially along lines 7—7 of FIG. 2.

Figure 8:
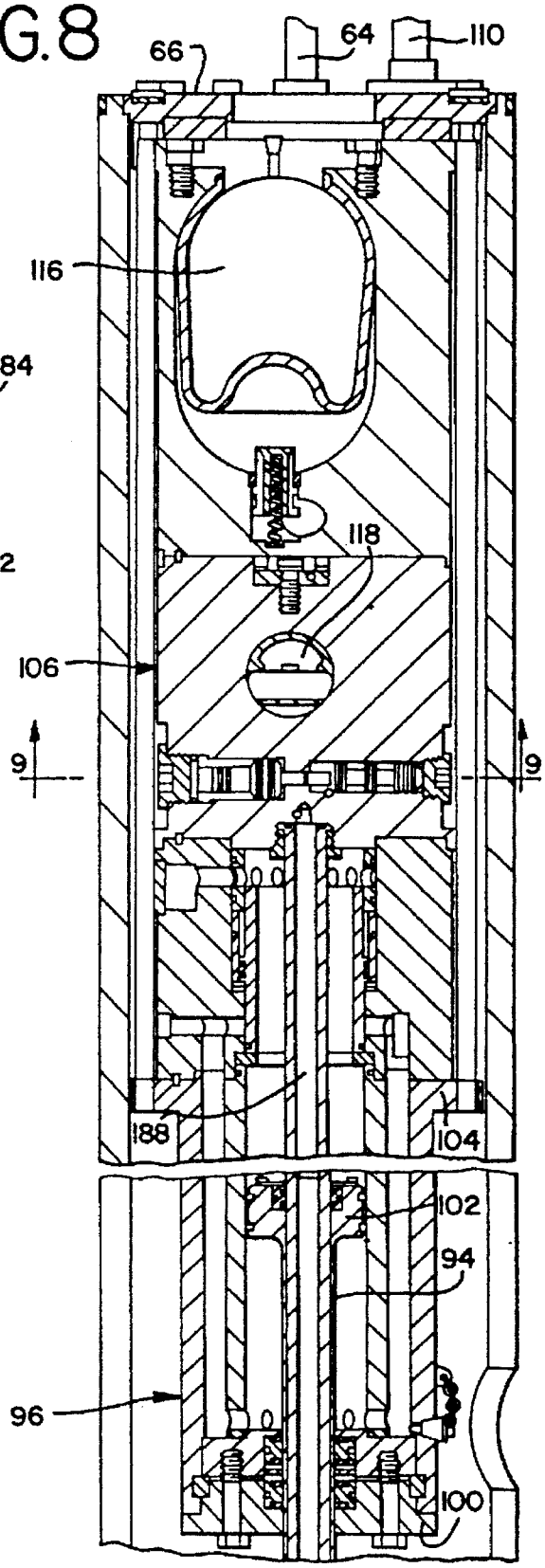

FIG. 8 is a fragmentary longitudinal cross-sectional view taken substantially along lines 8—8 of FIG. 1.

Figure 9:
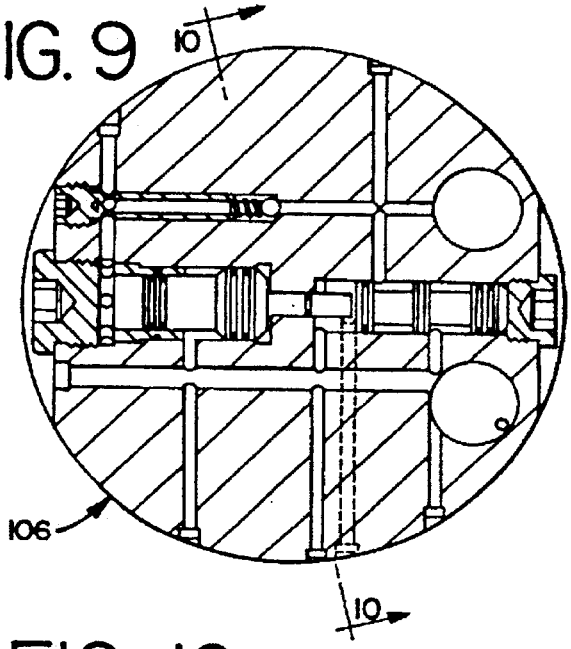

FIG. 9 is a transverse cross-sectional view taken substantially along lines 9—9 of FIG. 8.

Figure 10:
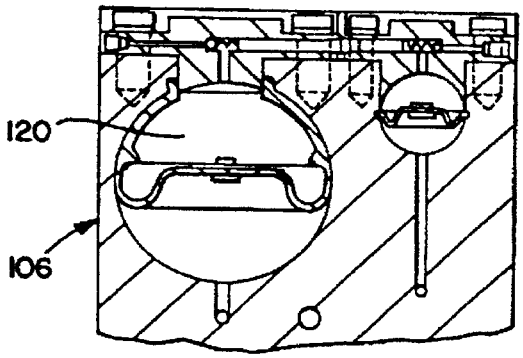

FIG. 10 is a cross-sectional view taken substantially along lines 10—10 of FIG. 9.

Figure 11:
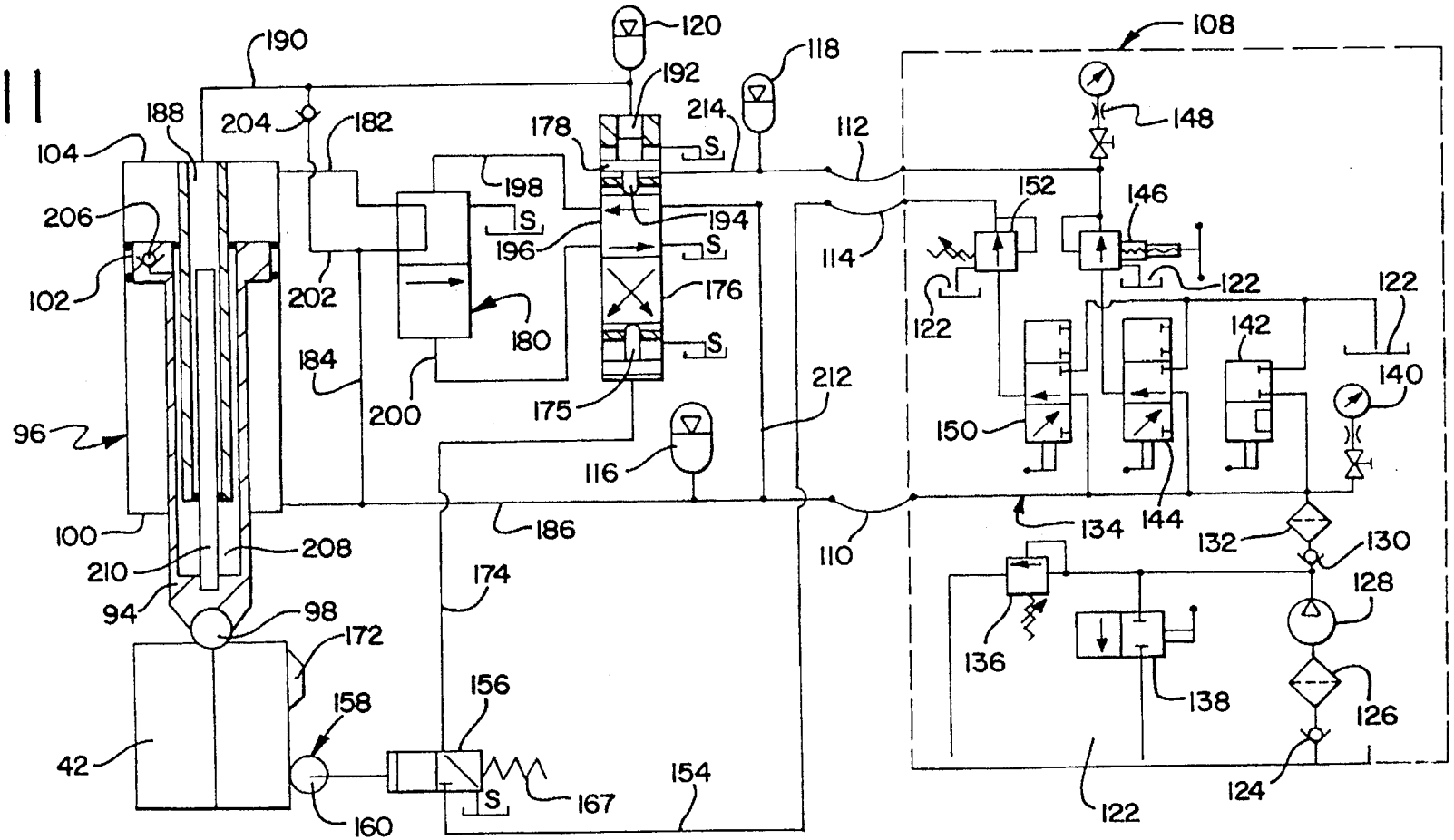

FIG. 11 is a schematic diagram of a hydraulic control system of the pile hammer constructed in accordance with the features of the present invention.

Figure 12:
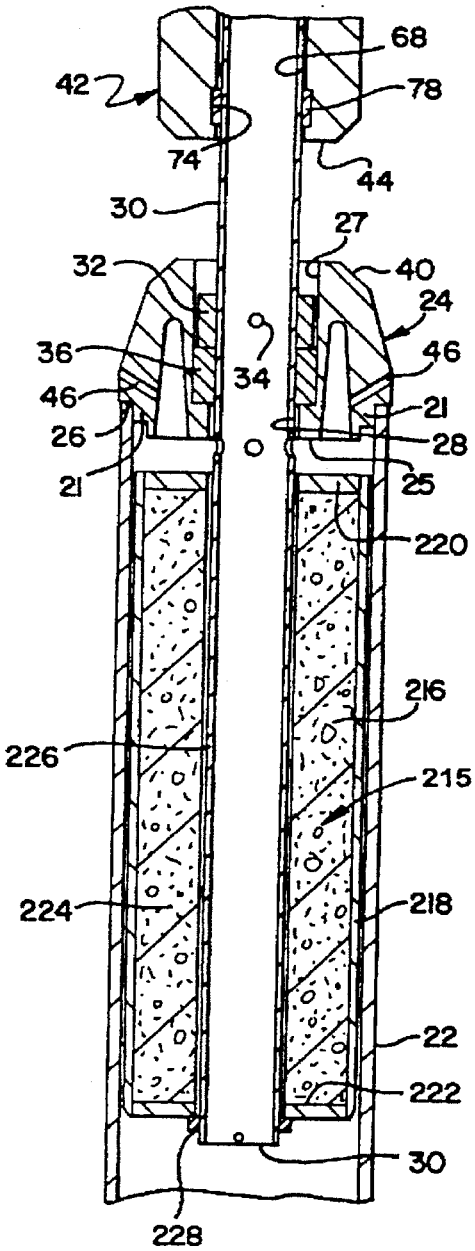

FIG. 12 is a longitudinal cross-sectional view of another embodiment of a lower end guidance and alignment system for the sea water pile hammer constructed in accordance with the present invention.

Figure 13:
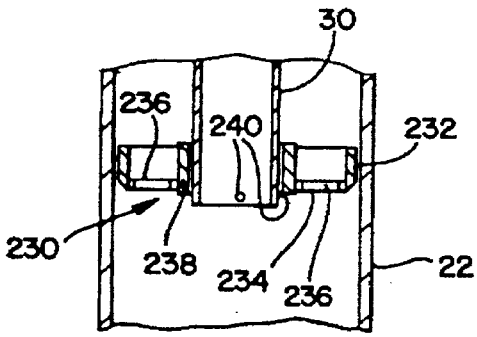

FIG. 13 is a transverse cross-sectional view of yet another embodiment of a lower end guidance and alignment system for the sea water pile hammer constructed in accordance with the present invention.

PREFERRED EMBODIMENT—DESCRIPTION

Referring now more particularly to the drawings and FIGS. 1–11, therein is illustrated one embodiment of a new and improved sea water pile hammer constructed in accordance with the features of the present invention and referred to generally by the reference numeral 20. The pile hammer 20 is designed and adapted to operate both above and below water and on dry land and utilizes either sea or fresh water as an operating fluid. The unique design of the pile hammer 20 eliminates the need for a sealed enclosure and the pile hammer is adapted to be supported entirely on a hollow piling 22 of tubular or circular cross-section which is to be driven into an ocean or lake bottom, or directly into the earth, as the case may be. The pile hammer 20 includes an annular pile cap 24 having a recess or shoulder 26 around an outer peripheral edge at the lower end designed to accommodate the upper end of the hollow piling 22 when the pile cap is seated in place thereon with a lower end portion 21 extending downwardly into the piling a distance below an upper end face thereof for maintaining coaxial alignment between the pile hammer and the piling.

The annular pile cap 24 is formed with an inwardly directed lower end flange 25 having a bore 28 with a diameter slightly larger than the outer diameter an elongated, upstanding, hollow tubular base 30 of the pile hammer 20. The elongated, upstanding, hollow tubular base 30 is provided with an annular, circular support ring 32 secured to the base at a level above the lower end by a plurality of radial pins 34 so that the lower end portion of the elongated, upstanding, hollow tubular base 30 extends the proper distance downwardly into an interior of the upper end portion of the hollow piling 22 in coaxial alignment therewith for limiting during operation both the angle and the offset between the longitudinal axis of the annular pile cap 24 and the longitudinal axis of the hollow piling 22, especially when the piling is being driven at a sloping angle other than the vertical.

The annular pile cap 24 is formed with a larger diameter bore or central body recess 27 above the bore 28 in the inwardly directed lower end flange 25 and a ring of shock absorbent material 36 is mounted in the central recess to surround the elongated, upstanding, hollow tubular base 30 above the lower end flange to support the annular, circular support ring 32 attached to the elongated, upstanding, hollow tubular base 30 and provide resilient cushioning between the pile cap and the base during pile driving operations.

In accordance with the invention, the annular pile cap 24 has an outer diameter generally matching, or slightly larger than that of the hollow piling 22 being driven and an upper end portion 38 of the outer surface of the pile cap is frustoconically tapered inwardly toward an annular, upper end face or anvil surface 40 designed to receive driving blows from a hollow, heavy, generally cylindrically shaped ram 42 mounted for reciprocal sliding movement on an upper portion of the elongated, upstanding, hollow tubular base 30 above the pile cap. The hollow, heavy, generally cylindrically shaped ram 42 has an annular lower end surface 44 dimensioned to match that of the annular, upper end face or anvil surface 40 and it should be noted that the lower end portion of the annular pile cap 24 is the widest portion of the entire pile hammer 20 and is only a little larger than the outer diameter of the hollow piling 22 being driven.

Because of the minimal width dimensions of the pile hammer 20 overall, minimal disturbance of the surrounding water occurs during a pile driving operation under water. Moreover, because the interior of the elongated, upstanding, hollow tubular base 30 is open and not sealed against the entry of water, only a very small volume of water is displaced between the annular, upper end face or anvil surface 40 and the annular lower end surface 44 during a driving blow of the hollow, heavy, generally cylindrically shaped ram 42 resulting in a minimal resistance and a minimal energy loss. Additionally, in order to preclude a water pressure build up during a driving blow of the hollow, heavy, generally cylindrically shaped ram 42 toward the annular pile cap 24, the pile cap is formed with a plurality of radially oriented, upwardly and outwardly sloping vent passages 46 extending between a lower end face and the upper end portion 38 of the pile cap. This plurality of radially oriented, upwardly and outwardly sloping vent passages 46 permits water or other fluid that is inside the hollow piling 22 and the elongated, upstanding, hollow tubular base 30 to move freely out during a driving stroke of the hollow, heavy, generally cylindrically shaped ram 42 so that minimal water or fluid resistance is encountered by the hollow, heavy, generally cylindrically shaped ram 42 on a downward driving stroke. The lower end portion of the elongated, upstanding, hollow tubular base 30 is provided with a plurality of openings 48 and a lower end wall 50 mounted in the base has a large central port 52, so that the water pressure inside of and surrounding the base within the hollow piling 22 is equalized.

In accordance with the invention, a guide assembly 54 (FIGS. 1, 2 and 4) is provided at the lower end of the elongated, upstanding, hollow tubular base 30 to maintain coaxial alignment between the elongated, upstanding, hollow tubular base 30 and the hollow piling 22. The guide assembly 54 includes a plurality of radially extending fingers 56, each having an enlarged head 58 at the outer surface for engaging the inside surface of the hollow piling 22. Each finger 45 includes a shank of reduced diameter extending inwardly toward the center of the elongated, upstanding, hollow tubular base 30 mounted in a bracket or block 60 carried on the lower surface of the lower end wall 50. Each radially extending finger 56 is adjustable radially in and out with respect to a bracket or block 60 so that the rounded surface of each enlarged head 58 is close to an adjacent inside surface of the hollow piling 22, and is engageable to limit misalignment of the elongated, upstanding, hollow tubular base 30 with the hollow piling 22 during operation of the pile hammer 20.

At a level between the lower end of the annular pile cap 24 and above the plurality of openings 48, the elongated, upstanding, hollow tubular base 30 is provided with a lift ring assembly 62 attached with pins 63 so that when the pile hammer 20 is lifted away from the hollow piling 22 by a cable or the like (not shown) attached to an apertured lift eye 64 on a top plate 66 on the elongated, upstanding, hollow tubular base 30, the annular pile cap 24 and hollow, heavy, generally cylindrically shaped ram 42 and associated components of the pile hammer are all carried along as a unit. This is true even though the annular, circular support ring 32 on the elongated, upstanding, hollow tubular base 30 merely rests on the shock absorbent material 36 and is not otherwise attached to the annular pile cap 24. Additionally the lift ring assembly 62 is located in such a way as to allow the movement of the annular pile cap 24 and the hollow piling 22 relative to the elongated, upstanding, hollow tubular base 30 when the hollow, heavy, generally cylindrically shaped ram 42 strikes the annular pile cap 24 and thus induces movement of the hollow piling 22.

In accordance with the present invention, the hollow, heavy, generally cylindrically shaped ram 42 may be formed of heavy metal such as steel or iron and is of elongated tubular shape with a central bore 68 extending between the annular lower end surface 44 and a matching size, upper end face 70. The diameter of the full length central bore 68 is slightly larger than the outer diameter of the elongated, upstanding, hollow tubular base 30 on which the hollow, heavy, generally cylindrically shaped ram 42 is slidably mounted for reciprocal movement between a predetermined, adjustable height, elevated position (FIG. 2) and a lower position (FIG. 1) wherein the annular lower end surface 44 is resting on the annular, upper end face or anvil surface 40 of the annular pile cap 24. The central bore 68 is formed with an upper annular groove 72 and a lower annular groove 74 in order to accommodate the upper resilient shock ring 76 and the lower resilient shock ring 78, both of which are formed of low friction material and engage the outer surface of the elongated, upstanding, hollow tubular base 30 to provide shock relief and low sliding friction between the hollow, heavy, generally cylindrically shaped ram 42 and the elongated, upstanding, hollow tubular base 30 on both upward lift stroke and downward driving strokes.

Adjacent an upper end portion, the body of the hollow, heavy, generally cylindrically shaped ram 42 is provided with one or more wall ports 80 to communicate between the inside and outside of the ram for equalizing the pressure during a pile driving operation. Adjacent a lower end portion of the hollow, heavy, generally cylindrically shaped ram 42 is formed a pair of diametrically opposed, radially oriented bores 82 for containing a pair of annular, resilient, shock element bearings 84 (FIG. 6) mounted on opposite, axle ends 86 of a transverse lift yoke 88. End portions of the transverse lift yoke 88, inwardly of the opposite, axle ends 86 are slidably disposed in longitudinally extending diametrically opposite guide slots 90 that are formed in the elongated, upstanding, hollow tubular base 30 above the annular pile cap 24. A central portion of the body of the transverse lift yoke 88 is connected to a clevis 92 on the lower end of a piston rod 94 (FIGS. 1 and 6) of a fluid operated lift cylinder 96 mounted inside an upper portion of the elongated, upstanding, hollow tubular base 30 by means of a removable cross pin 98 (FIG. 6.) The piston rod 94 extends upwardly into the fluid operated lift cylinder 96 through a central bore in an annular lower end wall 100 of the cylinder and is joined to a piston 102 that is fluid controlled to move between the annular lower end wall 100 and an upper end wall 104. The upper end wall 104 of the fluid operated lift cylinder 96 is secured to the lower end of the hydraulic base element 106 of generally cylindrical shape, mounted in the upper end of the elongated, upstanding, hollow tubular base 30 just below the top plate 66 of the pile hammer 20.

In accordance with the present invention, the pile hammer 20 is provided with a control system illustrated schematically in FIG. 11 for remote operative control of the hammer using sea water or other fluid as an operative fluid medium. The control system includes a fluid supply indicated as a whole by the power pack 108 which can be positioned at a convenient location such as a derrick barge several meters away from the hollow piling 22 being driven, or on land from a conventional pile driving rig. The power pack 108 is interconnected to the pile hammer 20 by means of large diameter, flexible, pressure line 110, regulating control line 112 and small bore flexible line 114, all of which lines pass through openings in the top plate 66 and are connected to the crank end hydraulic accumulator 116, head end accumulator 118, and control accumulator 120. These are contained in the hydraulic base element 106 in the upper end of the elongated, upstanding, hollow tubular base 30 above the fluid operated lift cylinder 96.

The power pack 108 is effective to start initial operation and to cease operation of the elongated, upstanding, hollow tubular base 30 beginning when the hollow, heavy, generally cylindrically shaped ram 42 is in an initial rest or lower position (FIG. 1) through one or more operating cycles, either in a manual or an automatic operating mode. The amount of impact energy from each downward driving or power stroke of the hollow, heavy, generally cylindrically shaped ram 42 depends upon the level of which the hollow, heavy, generally cylindrically shaped ram 42 is lifted to (FIG. 2) before it is released to drop down toward the annular pile cap 24 to exert a driving blow on the hollow piling 22.

The power pack 108 includes a fluid supply reservoir 122 (FIG. 11) which supplies fluid through a check valve 124 and filter 126 to an inlet side of hydraulic pump 128. High pressure fluid from an outlet side of the pump is fed through a filter check valve 130 and pump filter 132 to a high pressure manifold 134 connected to the large diameter, flexible, pressure line 110. Pressure output from the hydraulic pump 128 is adjustable via an adjustable relief valve 136 and manual dump valve 138 is also provided for returning the output fluid from the hydraulic pump 128 to the fluid supply reservoir 122.

A main pressure gauge 140 is provided so that an operator can ascertain the output pressure available from the hydraulic pump 128 into the high pressure manifold 134 and adjust the adjustable relief valve 136 to increase or decrease the pressure as desired. A depressurizing manual dump valve 142 is provided for depressurizing the high pressure manifold 134. A manual, two-way control valve 144 is provided for operation of the pile hammer 20 in an automatic mode and when the valve is in the position shown (FIG. 11,) pressurized fluid is directed into a manually adjustable pressure reducing valve 146 which is connected to supply control fluid at a selected reduced pressure to the regulating control line 112. A control line pressure gauge 148 is provided to monitor the hydraulic pressure of the fluid supplied to the regulating control line 112.

A manual operation valve 150 is provided for initiating operation of the pile hammer 20 and continuing operation in the manual mode. When the manual operation valve 150 is in the position shown in FIG. 11, output from the manual operation valve 150 is directed through a pressure relief valve 152 into the small bore flexible line 114.

Figure 5A:
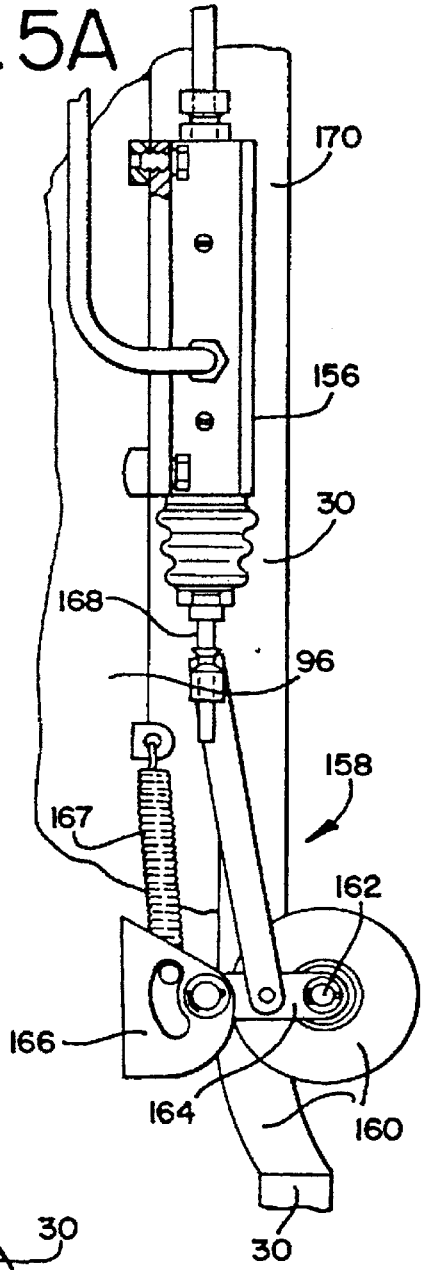
Figure 5B:
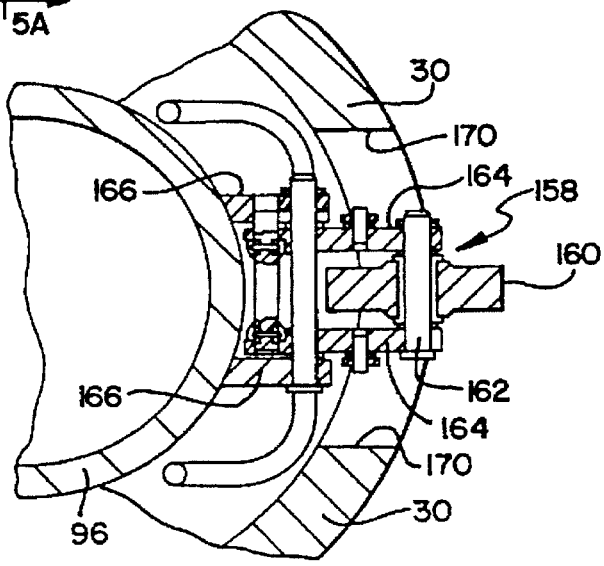

Pressurized fluid from the small bore flexible line 114 is directed via a passage or line 154 in the hydraulic base element 106 to a mechanically controlled valve 156 (FIGS. 5, 5A and 11) mounted on the fluid operated lift cylinder 96 and activated in response to the position of the hollow, heavy, generally cylindrically shaped ram 42 relative to the elongated, upstanding, hollow tubular base 30 or annular pile cap 24. The mechanically controlled valve 156 is actuated by a mechanism 158 (FIGS. 5, 5A and 5B) which senses the position of the hollow, heavy, generally cylindrically shaped ram 42 relative to the elongated, upstanding, hollow tubular base 30 by means of a cam follower roll 160 mounted on an axle 162. The axle 162 is supported at opposite ends on pivot arms 164 which are pivotally mounted at their inner ends on a pair of spaced apart brackets 166 secured to the fluid operated lift cylinder 96 as best shown in FIG. 5B. The pivot arms 164 are biased in a clockwise direction by spring 167 (FIG. 5A) to move the cam follower roll 160 to an outward position and in this position a stem 168 of the mechanically controlled valve 156 is pulled outwardly as shown in FIG. 5. An elongated slot 170 is formed in the elongated, upstanding, hollow tubular base 30 to accommodate the mechanism 158 and permit the cam follower roll 160 to an outward position and in this position, a stem 168 of the mechanically controlled valve 156 is pulled outwardly as shown in FIG. 5. A slot 170 is formed in the elongated, upstanding, hollow tubular base 30 to accommodate the mechanism 158 and permit the cam follower roll 160 to extend outwardly thereof (FIG. 5B,) until engaged by the inside surface of the hollow, heavy, generally cylindrically shaped ram 42 (FIG. 2) which forces the cam follower roll 160 inwardly causing the mechanism 158 to move up and shift the position of the mechanically controlled valve 156. In FIG. 11, the hollow, heavy, generally cylindrically shaped ram 42 is shown to have a cam 172 at the upper end for engaging the cam follower roll 160 only in an illustrative sense.

The mechanically controlled valve 156 is connected by a line 174 to a pusher 175 at one end of a main pilot valve 196 connected to control a main operating valve 180 which in turn is connected via head end main operating valve connecting line 182 and crank end main operating valve connecting line 184 to the fluid operated lift cylinder 96 above and below the piston 102. The crank end main operating valve connecting line 184 connected to the lower end of the fluid operated lift cylinder 96 is supplied with high pressure fluid from the crank end hydraulic accumulator 116 and the large diameter, flexible, pressure line 110 through the crank end manifold 186.

Regulation and control of the selectively adjustable setting or height of the hollow, heavy, generally cylindrically shaped ram 42 in readiness to drop down on in a pile driving stroke is provided by a small diameter inner control cylinder 188 formed inside the piston rod 94 of the fluid operated lift cylinder 96. The small diameter inner control cylinder 188 is connected via the small diameter inner control cylinder line 190 to the control accumulator 120 which in turn is connected to a differential pressure block 192. The pressure difference between the head end accumulator 118 and the control accumulator 120 is sensed across the comparator valve 178 and an upper pusher 194 may be activated to move the main pilot valve 196 which in turn activates the main operating valve 180 for activating and controlling the height of the lift of the hollow, heavy, generally cylindrically shaped ram 42 provided by the fluid operated lift cylinder 96.

Opposite ends of the main operating valve 180 are in communication with the ports on the main pilot valve 196 through top pilot line 198 and bottom pilot line 200, the upper end of the fluid operated lift cylinder 96 is connected to a sump S to discharge fluid into the surrounding environment while the lower end of the fluid operated lift cylinder 96 is still pressurized from the crank end manifold 186 so that the piston 102 and piston rod 94 begin to rise. The crank end main operating valve connecting line 184 and the small diameter inner control cylinder line 190 are interconnected via an interconnection line 202 and an interconnection check valve 204 so that the small diameter inner control cylinder 188 reflects the highest of the pressures from the crank end main operating valve connecting line 184 or the control accumulator 120. A piston check valve 206 is provided on the piston 102 to bleed off excess pressure in a inner cylinder lower end portion 208 of the small diameter inner control cylinder 188 around a control rod 210 as the hollow, heavy, generally cylindrically shaped ram 42 is moved upwardly on a return stroke by pressure on the underside of the piston 102.

Referring now to FIG. 12, therein is illustrated an alternate embodiment of an alternate guide system 215 for limiting the amount of axial and radial misalignment between the elongated, upstanding, hollow tubular base 30 and the hollow piling 22 being driven.

The alternate guide system 215 provides a heavy counterweight 216 for applications where the hollow piling 22 is to be driven at a slope angle other than the vertical. The heavy counterweight 216 is formed by an elongated hollow tubular outer shell 218 of formed metal and having an outside diameter slightly less than the inside diameter of the hollow piling 22. Upper annular end wall 220 and lower annular end wall 222 are provided to contain a hollow tubular ballast element 224 comprising concrete or steel and surrounding an elongated tubular inner side wall 226 formed of metal, having an inside diameter dimensioned to accommodate a lower end portion of the elongated, upstanding, hollow tubular base 30 which is open at the lower end. The heavy counterweight 216 rests on a support ring 228 secured to the outer surface of the lower end portion of the elongated, upstanding, hollow tubular base 30.

In FIG. 13 is illustrated another embodiment of a second alternate guide system 230 for limiting the amount of axial and radial misalignment between the elongated, upstanding, hollow tubular base 30 and the hollow piling 22 being driven. The second alternate guide system 230 comprises a relatively light weight and short length tubular outside side wall 232 having an outside diameter of the hollow piling 22 being driven. The relatively light weight and short length tubular outside side wall 232 is attached to the outer peripheral edge of an annular, radial end wall 234 of circular outline and has a plurality of ports 236 for pressure equalization above and below the wall. An inner side wall 238 of short length is attached to the annular, radial end wall 234 and is slidably disposed on the elongated, upstanding, hollow tubular base 30 above one or more radial support pins 240 at the lower end of the body.

PREFERRED EMBODIMENT—OPERATION

Before starting operation of the pile hammer 20, the hollow, heavy, generally cylindrically shaped ram 42 is resting at a bottom position as shown in FIGS. 1 and 11. The mechanically controlled valve 156 is in the right hand position as shown in FIG. 11 and the main operating valve 180 and the main pilot valve 196 are in the respective positions as shown. The manual operation valve 150 and manual, two-way control valve 144 are both closed. The hydraulic pump 128 is then put into operation and working fluid fills the crank end manifold 186, crank end hydraulic accumulator 116, and control accumulator 120. The manual, two-way control valve 144 is moved into a middle (working) position and fluid is then supplied to the manually adjustable pressure reducing valve 146 and fills the regulating control line 112 and head end accumulator 118. Then using the manually adjustable pressure reducing valve 146, pressure is selected to correspond to the desired height of an upward lift stroke of the hollow, heavy, generally cylindrically shaped ram 42. The system has a specially calibrated scale on which the value of ram height corresponds to the value of pressure.

To put the pile hammer 20 into operation, the manual operation valve 150 is moved into a middle working position and working fluid is supplied through an open mechanically controlled valve 156 to the pusher 175. The pusher 175 moves the main pilot valve 196 into an upper position, which in turn shifts the main operating valve 180 and closes off the hydraulic path which connects the rod end and the piston end of the fluid operated lift cylinder 96. The piston end becomes connected to the head end main operating valve connecting line 182 leading to a sump S for discharge into the surrounding medium of water or into another suitable body of water. This action causes the hollow, heavy, generally cylindrically shaped ram 42 to move up and force fluid out of the internal cavity of the small diameter inner control cylinder 188 of the piston rod 94, all with the assistance of the control rod 210 and causing compression of fluid in the control accumulator 120. Forces acting upon the comparator valve 178 of the main pilot valve 196 provide a pressure comparance or measurement of the pressure difference between the fluid in the head end accumulator 118 and the control accumulator 120. When the pressure difference becomes zero, the upper pusher 194 moves the main comparator valve 196 down and forces fluid out into the line 174 via the mechanically controlled valve 156 to the sump S.

While the main pilot valve 196 is switching position, the main operating valve 180 is also activated so that working fluid drainage through an outlet to the sump S is stopped and the piston end of the fluid operated lift cylinder 96 then becomes connected with the rod end. This results in a stoppage of the upward movement of the hollow, heavy, generally cylindrically shaped ram 42, and after the ram stops moving upwardly, it drops down in a pile driving stroke under its own weight, boosted by additional effort from the fluid operated lift cylinder 96 due to a difference in cross-sectional areas of the piston rod 94 and the small diameter inner control cylinder 188.

After a downward blow of the hollow, heavy, generally cylindrically shaped ram 42 upon the annular, upper end face or anvil surface 40 of the annular pile cap 24, the mechanically controlled valve 156 is returned to occupy a right hand position (FIG. 11) and transmits high pressure fluid to the pusher 175 causing the main pilot valve 196 and the main operating valve 180 to switch position. The operating cycle is then automatically repeated. Stoppage of the pile hammer 20 is accomplished by moving the manual operation valve 1/50 into an upper position. The height of the hollow, heavy, generally cylindrically shaped ram 42 when dropped determines the impact energy value obtained in a downward, pile driving stroke and the value may be adjusted during hammer operation by a simple adjustment of the pressure value output from the manually adjustable pressure reducing valve 146, which acts as a setter in determining the height of a lifting upward stroke of the hollow, heavy, generally cylindrically shaped ram 42 by the fluid operated lift cylinder 96.

CONCLUSIONS AND SCOPE

Obviously, many modifications and variations of the present invention are possible in light of the above teachings. Thus, it is to be understood that, within the scope of the appended claims, the invention may be practiced otherwise than as specifically described above.

What is claimed is:

1. A pile hammer for driving a hollow pile having a longitudinal axis by applying repeated axially directed driving blows to an upper end thereof, said pile hammer comprising:

an annular pile cap adapted to rest on the upper end of the pile and having an upper annular anvil surface in vertical alignment with the upper end of the pile;

said pile cap having a central axial bore extending entirely through said pile cap;

a base having an annular intermediate portion supported upon the pile cap and having a lower end portion extending downwardly from said intermediate portion through said central axial bore into said hollow pile below said cap;

said base including a hollow tubular upper portion extending upward from said intermediate portion;

an axially elongated hollow ram encircling and slidably mounted on said hollow tubular upper portion for movement between upper and lower positions and having a lower end hammer face adapted to strike said anvil surface when said ram is in said lower position; and lift means mounted within said hollow tubular upper portion of said base and within said ram when said ram is in said upper position for lifting said ram to said upper position, and means for releasing said ram and permitting said ram to drop downwardly to said lower position to strike a driving blow with said hammer face against said anvil surface.

2. The pile hammer of claim 1, including:

guide means adjacent said lower end portion of said base engageable with the pile for limiting axial and radial misalignment between said base and the pile.

3. The pile hammer of claim 2, wherein:

said guide means includes a plurality of elements extending radially outwards from said lower end portion of said base having outer ends adapted for stopping engagement against an inside surface of the pile to limit said axial and radial misalignment.

4. The pile hammer of claim 2, wherein:

said guide means includes an elongated member mounted on said lower end portion of said base having a cylindrical guide surface facing the inside surface of the pile.

5. The pile hammer of claim 1, wherein:

said lift means includes a fluid cylinder means mounted inside said hollow tubular upper portion of said base for lifting said ram to said upper position.

6. The pile hammer of claim 5, wherein:

said lift means includes accumulator means mounted inside said hollow tubular upper portion of said base for supplying pressurized fluid to said fluid cylinder means for lifting said ram.

7. The pile hammer of claim 6, wherein:

said lift means includes a source of fluid pressure remote from said accumulator means for supplying pressurized fluid to said accumulator means.

8. The pile hammer of claim 5, wherein:

said fluid cylinder means includes piston rod means extending axially downwardly inside said upper portion of said base.

9. The pile hammer of claim 8, wherein:

said hollow tubular upper portion of said base is formed with elongated axially extending slots on opposite sides; and including yoke means connected to a lower end of said piston rod means extending outwardly through said slots for engaging said ram to lift said ram when said piston rod is moved upwardly into said cylinder means.

10. The pile hammer of claim 9, including:

shock absorbers interconnected between said yoke means and said ram for reducing shock forces on said piston rod means and cylinder means as said ram strikes said anvil surface on a driving blow.

11. The pile hammer of claim 1, wherein:

said lower end portion of said base includes radially outwardly extending lift means engageable with said pile cap for lifting said pile cap in response to lifting of said base upward from the pile.

12. A submersible sea water pile hammer for driving a submerged hollow pile having a longitudinal axis by applying repeated axially directed driving blows to an upper end thereof, said pile hammer comprising:

pile cap means having a lower end portion adapted to engage the upper end of the hollow pile for supporting the pile hammer on the pile;

an elongated hollow base extending downwardly and upwardly through said pile cap means and supported by said pile cap means;

ram means mounted on said base above said pile cap means for axial movement relative to said base toward and away from said pile cap means; and lift means mounted on said base above said pile cap means for lifting said ram means to a predetermined elevation above said pile cap and release means for releasing said ram means to drop downwardly to strike a driving blow against said cap means said base and said pile cap means including vent passage means for equalizing sea water pressure at the exterior of the pile hammer with sea water pressure at the interior of said base and the pile.

13. The sea water pile hammer of claim 12, wherein:

said pile cap means is hollow and said lower end portion of said pile cap means projects downwardly inside the hollow pile to engage an inside surface of the hollow pile for maintaining coaxial alignment between said base and the pile.

14. The sea water pile hammer of claim 13, wherein:

said vent passage means includes a plurality of vent passages extending from an inside surface of said pile cap means to an outside surface of said pile cap means above the pile.

15. The sea water pile hammer of claim 14, wherein:

said vent passage means further includes at least one port extending between the interior and the exterior of said hollow base adjacent said lower end portion of said pile cap means within the pile for equalizing fluid pressure inside and outside of said hollow base below said pile cap means.

16. The sea water pile hammer of claim 13, wherein:

said pile cap means includes an annular, radially extending upper end forming an anvil surface to receive driving blows from said ram means and a downwardly directed support surface resting on the upper end of the pile, an outside surface of said pile cap means extending downwardly and outwardly from said anvil surface to said support surface.

17. The sea water pile hammer of claim 12, wherein:

said ram means includes upper and lower ends and a central bore between said upper and lower ends for accommodating said hollow base extended therethrough and a lower annular end face, said pile cap means including an annular, radially extending upper end forming an anvil surface dimensioned to match said lower annular end face of said ram means.

18. The sea water pile hammer of claim 17, including:

upper and lower, low friction resilient cushion rings between upper and lower end portions of said ram means and said hollow base.

19. The sea water pile hammer of claim 17, wherein:

said ram means is formed with port means intermediate said upper and lower ends of said ram means for providing fluid communication between said central bore and the exterior of said ram means.

20. The sea water pile hammer of claim 12, including:

said hollow base having a lower end and guide means adjacent said lower end of said hollow base engageable with an interior surface of the pile for limiting the amount of axial and radial misalignment between the pile and said base.

21. The sea water pile hammer of claim 20, wherein:

said guide means comprises a tubular member secured onto said lower end portion of said hollow base and having an outer wall surface closely facing an adjacent interior surface of the pile.

22. The sea water pile hammer of claim 21, wherein:

said tubular member has an inner wall surface in coaxial alignment with and surrounding said hollow base; and ballast means in said member between said inner and outer surfaces for adds to help maintain the pile hammer seated on the upper end of the pile.

23. The sea water pile hammer of claim 21, wherein:

said tubular member has an inner wall surface in coaxial alignment with and surrounding said hollow base; and said guide means includes a lower end wall extending from said inner wall to said outer wall at a lower end of said guide means.

24. The sea water pile hammer of claim 23, wherein:

said lower end wall is provided with at least one port for equalizing pressure above and below said guide means.

* * * * *